US005115820A

United States Patent [19]

Hauser et al.

[11] Patent Number: 5,115,820

[45] Date of Patent: May 26, 1992

[54] SMOKABLE ARTICLE

[75] Inventors: Bernhard Hauser, Schenefeld; Guillermo Gerding, Hamburg; Knut Möller, Hamburg; Bernd-Henrik Müller, Hamburg; Gert Rudolph, Hamburg; Wolfgang Wiethaup, Hamburg, all of Fed. Rep. of Germany

[73] Assignee: B.A.T. Cigarettenfabriken GmbH, Hamburg, Fed. Rep. of Germany

[21] Appl. No.: 495,076

[22] Filed: Mar. 19, 1990

[30] Foreign Application Priority Data

Mar. 28, 1989 [DE] Fed. Rep. of Germany ..... 3910059

[51] Int. Cl.[5] ..... A24D 1/00; A24D 1/02; A24D 1/18

[52] U.S. Cl. ..... 131/194; 131/196; 131/359; 131/364; 131/365

[58] Field of Search ..... 131/364, 194, 195, 356, 131/369, 359, 365

[56] References Cited

U.S. PATENT DOCUMENTS 4,474,191 10/1984 Steiner .
4,779,631 10/1988 Durocher et al. .
4,991,606 2/1991 Serrano et al. .
5,060,676 10/1991 Hearn et al. .

. FOREIGN PATENT DOCUMENTS 0264195 4/1988 European Pat. Off. .

*Primary Examiner*—V. Millin
*Attorney, Agent, or Firm*—Armstrong, Nikaido, Marmelstein, Kubovcik & Murray

[57] ABSTRACT

A smokable article including an aerosol generating zone which has a combustion element and a carrier for an aerosol precursor which coaxially surrounds the combustion element, flow passages in the aerosol generating zone and a mouthpiece. The combustion element includes axial flow passages extending over its entire length and a jacket formed of a gas-impermeable heat-insulating material. The jacket is surrounded at a distance by a concentric sleeve of a gas-impermeable material so that between the jacket and the sleeve at least one flow space results; the sucked-in air flows through the flow passages in the combustion element, then back through the flow space between the jacket and the sleeve and finally through the carrier for the aerosol precursor to the mouthpiece. The carrier includes a precursor, and the combustion element has a plurality of axial passages.

20 Claims, 5 Drawing Sheets

SMOKABLE ARTICLE

BACKGROUND OF THE INVENTION

1. Field of the Invention

The invention relates to a smokable article comprising an aerosol generating zone which includes a combustion element and a carrier for an aerosol precursor which coaxially surrounds the combustion element, flow passages in the aerosol generating zone, a mouthpiece, and at least one outer sheath or wrapper.

2. Description of the Prior Art

Such a smokable article is disclosed in European Patent Publication No. 0 264 195 and comprises an aerosol generating zone consisting of a combustion element and a carrier for an aerosol precursor coaxially surrounding the combustion element as well as flow passages in the aerosol generating zone, a mouthpiece and possibly at least one sheath or wrapper for the aerosol generating zone and the mouthpiece.

In this known smokable article three longitudinal passages are provided in the aerosol generating zone and lie between the rod-shaped combustion element and the carrier for the aerosol precursor which in this embodiment is formed by a substrate of ceramic fibres. The advantage of this coaxial arrangement of inner combustion element and outer carrier for the aerosol precursor resides in the compact structure; a disadvantage is, however, the relatively poor heat transfer from the ignited combustion element to the aerosol precursor since the contact surface between the carrier and the combustion element is only relatively small. The air sucked in and flowing through the longitudinal passages between the combustion element and carrier is not sufficiently heated so that the necessary aroma amounts do not escape into the air from the aerosol precursor carrier. Moreover, there is no constrained guiding of the warm air through the aerosol precursor carrier so that the temperature necessary for the aerosol formation in the carrier is not reached.

SUMMARY OF THE INVENTION

The invention is therefore based on the problem of providing a smokable article of the specified category in which above-mentioned disadvantages do not occur. In particular a smokable article is to be proposed in which a more intensive heating of both the carrier for the aerosol precursor and the sucked-in air is ensured, combined with a constrained guiding of the hot gases through the aerosol precursor carrier.

The invention therefore proposes in a smokable article comprising an aerosol generating zone including a combustion element and a carrier for an aerosol precursor which coaxially surrounds the combustion element, flow passages in the aerosol generating zone, a mouthpiece and at least one outer sheath, the improvement in that the combustion element comprises axial flow passages extending over its entire length, and a jacket including a gas impermeable heat-insulating material, the jacket is surrounded in spaced relationship by a concentric sleeve of a gas-impermeable material so that between the jacket and the sleeve at least one flow space results and the mouth side end of the sleeve is sealed and between the mouth side end of the combustion element and the mouth side end face of the sleeve a flow deflection space is formed.

The advantages achieved with the invention are based on a deflection of the air flow which after flowing through the combustion element is led back at the outer side of the combustion element and only then flows through the coaxial carrier for the aerosol precursor arranged radially outwardly. In this manner a combined effect of the various modes of heat transfer results because not only the heat conduction and convection but also the radiation heat may have an effect on the air, in particular also on the aerosol precursor carrier.

Thus, not only the sucked-in air but also the aerosol precursor on the carrier is sufficiently heated so that enough aroma substances are released and taken in by the smoker who obtains the desired intensive flavour impression.

By corresponding design of the material specifications and dimensionings of the individual parts a wide spectrum of possible different solutions is achieved.

The flow passages between the gas-impermeable heat-insulating jacket for the combustion element, for example a ceramic layer, and the gas-impermeable metal layer arranged coaxially thereto may either be formed by spacers or by a correspondingly corrugated or serrated configuration of the heat-insulating jacket and/or the metal layer.

Whereas the combustion element has the usual structure, i.e. comprising generally active carbon, for the carrier of the aerosol precursor various embodiments may be used. Thus, for example, a multilayer ceramic fibre fleece may be provided which is surrounded by a sheath or wrapper material of low porosity. As sheath material in particular paper, cellulose acetate foil or plastic foil may be used.

As an alternative to this a porous ceramic hollow body may be employed which is configured for example as tube element and has a gas-impermeable circumferential surface or is surrounded by a sheath material having low porosity. For this purpose as well paper, cellulose acetate foil or a plastic foil may be employed.

A particularly preferred embodiment for the carrier of the aerosol precursor is a hollow cylinder which is filled with porous granulate impregnated with the aromatic substances and comprises openings in the mouth side cross-sectional area and in the ignition side area of its inner surface, so that the deflected air heated by the combustion element can flow into the hollow cylinder. As wall materials for the hollow cylinder, metallic materials, ceramic materials, cardboard, especially for the outer wall, or other suitable materials may be employed.

This variant is particularly expedient for production-technical reasons because the capsule-shaped carrier for the aerosol precursor may be made integrally with the integrated inner metal layer, e.g. as sleeve, and pushed onto the combined combustion/ceramic element from behind. For all variants of the aerosol precursor carrier the latter may be partially or completely replaced by tobacco material. Tobacco materials which are granulated, extruded or prepared as tobacco foil are particularly suitable which could also be biotechnically obtained from cell cultures and exhibit increased contents of flavour and active substances, in particular increased nicotine contents.

BRIEF DESCRIPTION OF THE DRAWINGS

The invention will be described in detail hereinafter with the aid of the examples of embodiment with reference to the attached schematic drawings, wherein.

DETAILED DESCRIPTION OF THE PREFERRED EMBODIMENTS

Figure 1:
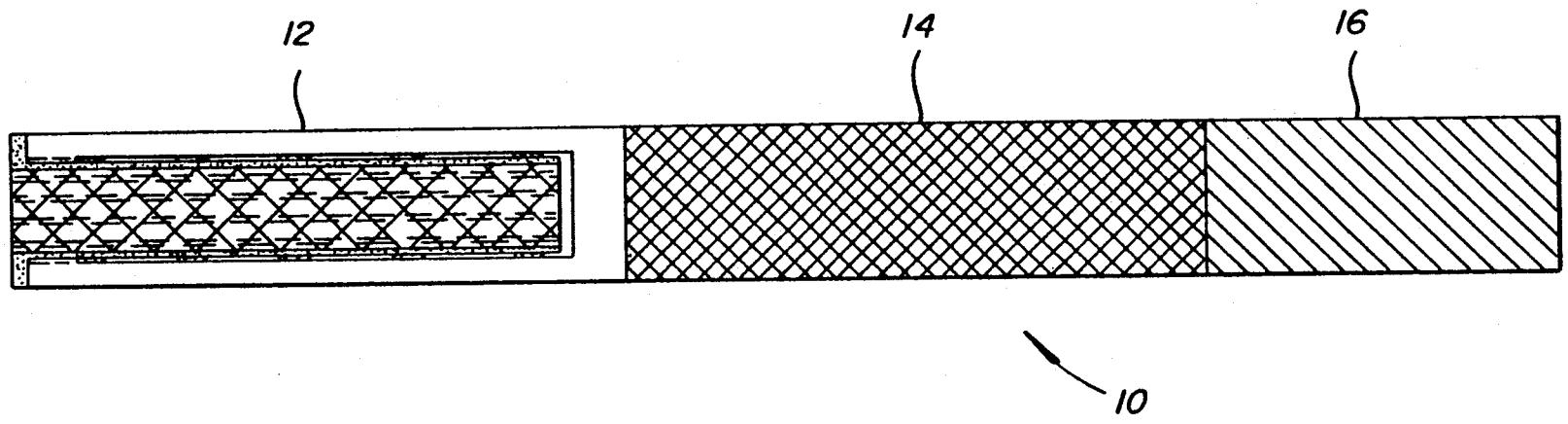
FIG. 1 shows in longitudinal section an overall view of a smokable article.

The smokable article apparent from FIG. 1, indicated generally by the reference numeral 10, has the basic structure known already from European Patent Publication No. 0 264 195, i.e. has three basic elements which are joined together to form the usual elongated cylindrical form of a conventional smokable article, i.e. an aerosol generating zone 12, an intermediate zone 14 filled with tobacco material and a filter 16 at the mouth side end. The tobacco material in the intermediate zone 14 in turn gives up aromatic and active substances to the aerosol flowing through. The tobacco material can comprise, apart from cut tobacco, also at least partially sheet tobacco, extruded tobacco or biotechnically produced tobacco materials. Alternatively, there may be a cavity between the aerosol generating zone 12 and the intermediate zone 14 filled with tobacco material; possibly, the intermediate zone 14 can be dispensed with.

These three basic regions 12, 14 and 16 are surrounded and thereby joined together by a common sheath, for example of cigarette paper. Said sheath is not shown in FIG. 1. In addition, in each case two basic elements may be joined with one common sheath respectively.

Figure 2:
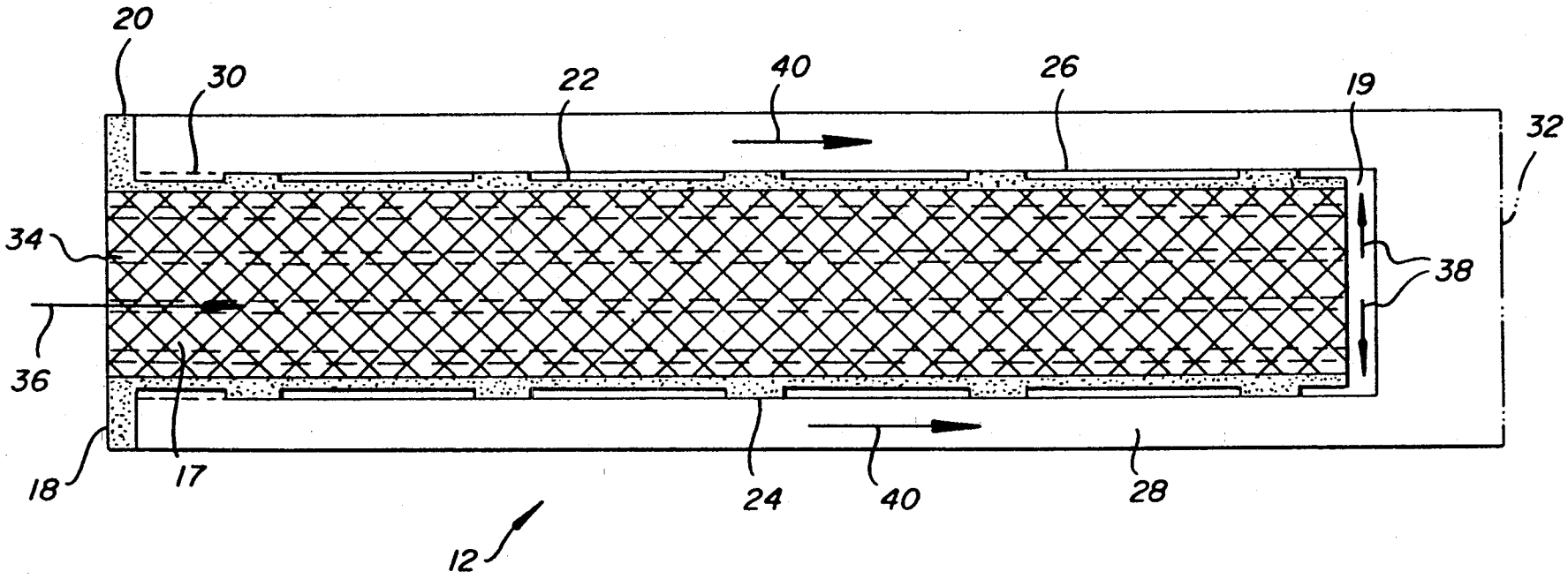
FIG. 2 shows an enlarged view of the aerosol generating zone of the smokable article according to FIG. 1 as longitudinal section.

FIG. 2 shows in enlarged scale a longitudinal section through the aerosol generating zone 12 of the smokable article 10 according to FIG. 1. Said aerosol generating zone 12 comprises a cylindrical combustion element 17 of active carbon with longitudinal passages 34 which extend over the entire axial length of the combustion element 17.

Figures 4, 5:
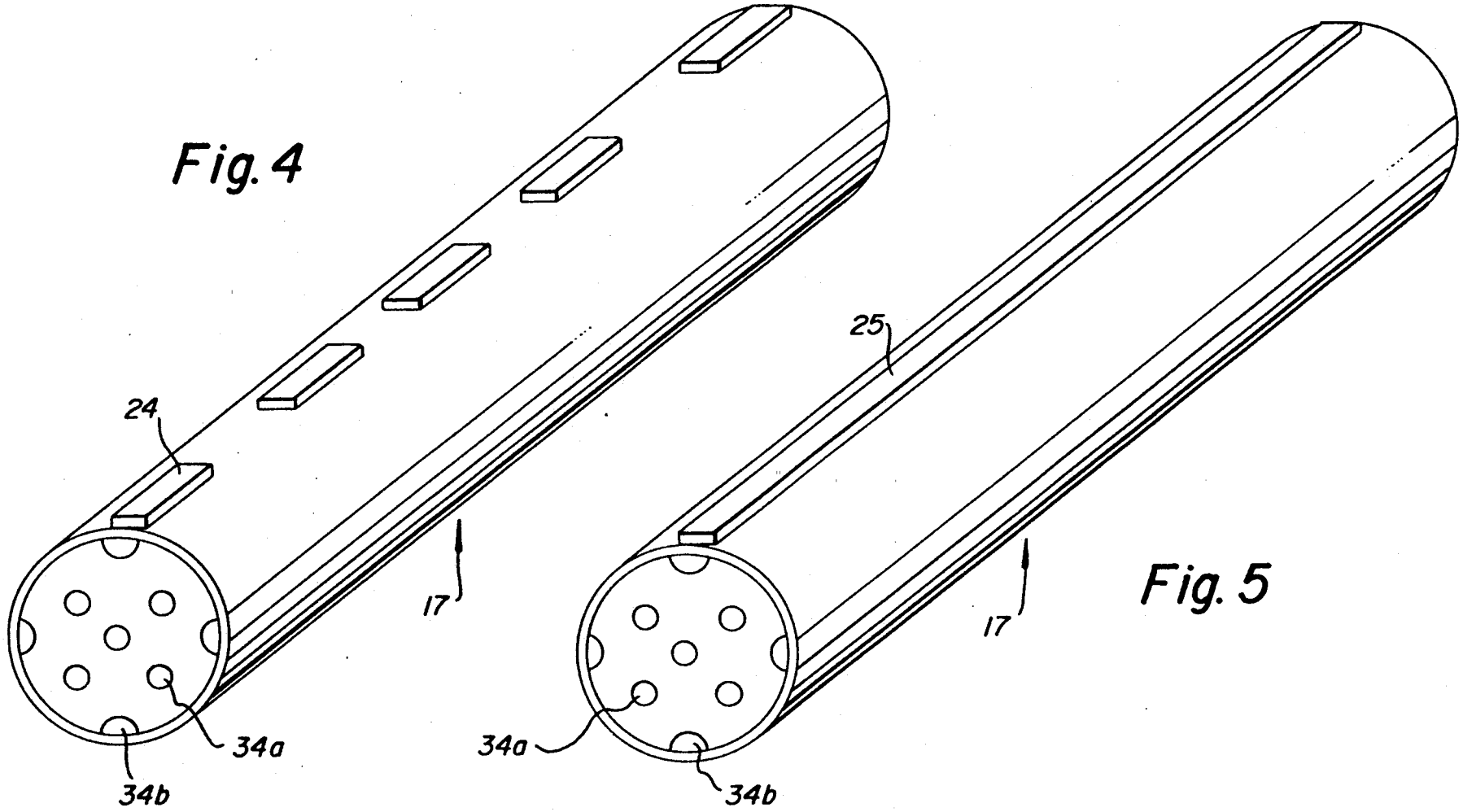
FIG. 4 shows a perspective view of a first embodiment of the combustion element.
FIG. 5 shows a perspective view of a second embodiment of the combustion element.
Figure 6:
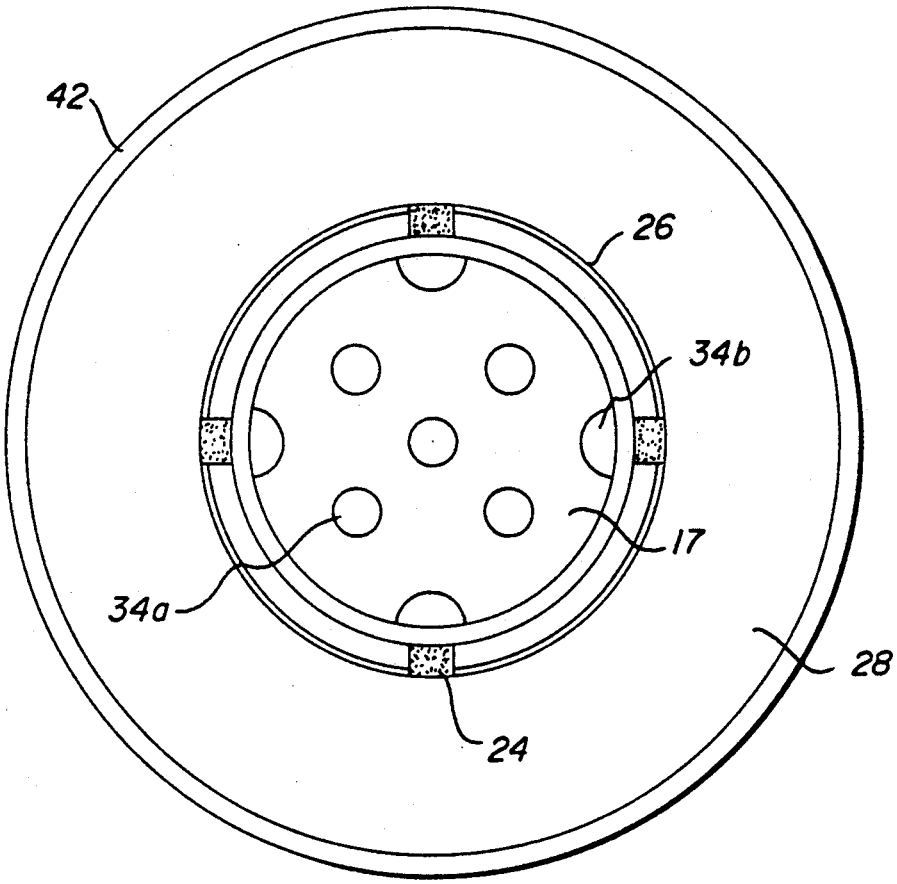
FIG. 6 is a radial section through the aerosol generating zone of the embodiment according to FIG. 2.

As can be seen in particular from FIGS. 4 to 6, in which embodiments of the combustion element 17 are shown, said longitudinal passages 34 may be formed in the interior of the combustion element 17 as bores 34*a* having circular cross-section and/or at the edge of the combustion element 17 as bores 34*b* with partially circular, in particular semicircular, cross-section. The passages 34*b* in the peripheral region of the combustion element 17 may alternatively be formed by a corrugated, serrated or stepped formation of the peripheral surface of the combustion element 17 and/or the surrounding sleeve 22.

On the outside the combustion element 17 with the flow passages 34 is surrounded by a gas-impermeable heat-insulating jacket 18 which is formed by a sleeve 22 of a ceramic material.

According to the representation in FIG. 2 the sleeve 22 is provided on the left side on the ignition side with a projecting annular flange 20 which extends from the sleeve 22 radially outwardly and is preferably made integrally with the sleeve 22.

The jacket 18 or the sleeve 22 thus leaves free the ignition side end face of the combustion element 17, on the left according to the illustration in FIG. 2, and the mouth side end face of the combustion element 17, on the right according to the illustration in FIG. 2.

The sleeve 22 is provided on its outer surface with strip-shaped spacers 24 which extend axially over the entire length of the combustion element 17, as apparent from FIG. 4, where only one row of spacers 24 is indicated. In practice, several rows of spacers 24 must be provided spaced equally over the circumference of the combustion element 17, in particular four rows of spacers 24, as illustrated in FIG. 6.

Alternatively, FIG. 5 shows a variant in which individual spacers 24 are not provided but instead one spacer 25 extending over the entire length of the combustion element 17. In this case as well, in practice, again at least four spacers 25 are equally distributed over the periphery of the combustion element 17.

The spacers 24, 25 are preferably formed integrally with the sleeve 22 of the jacket 18, i.e. they likewise consist of a ceramic material.

The sleeve 22 or the spacers 24 are surrounded in the radial direction by a gas-impermeable coaxial and concentric sleeve 26 composed of a material having suitable thermal conductivity, in particular a metallic or ceramic material.

Thus, between the outer surface of the sleeve 22 of ceramic material on the one hand and the inner surface of the sleeve 26 of metallic material on the other hand, with the aid of spacers 24 a flow cavity arises through which the sucked-in air flows in a manner still to be explained.

Alternatively, this flow cavity may however be formed differently, for example by a corrugated or serrated configuration of the sleeve 22 and/or of the ceramic or metallic sleeve 26. This also ensures the formation of intermediate spaces for the air flowing through.

As can be seen from FIG. 2 the axial length of the combustion element 17 is somewhat less than the axial length of the sleeve 26 composed of the metallic or ceramic material, so that on the right-hand side according to the illustration in FIG. 2 a cavity 19 arises between the end of the combustion element 17 and the end of the sleeve 26, the latter being closed on this side. The function of said cavity 19 is to be explained below.

The sleeve 26 of the metallic material is surrounded radially outwardly by a further hollow body 28 serving as carrier for the aerosol precursor, i.e. being coated and/or impregnated with aroma substances.

Said hollow body 28 may for example be formed by a tubular element composed of a porous ceramic material with a gas-impermeable peripheral surface or with a sheath of a material of low porosity, the ceramic material being impregnated with aroma substances.

Alternatively, the hollow body 28 may also be formed by a hollow cylinder which is filled with an impregnated porous granulate. Said hollow cylinder can be made integrally with the sleeve 26 from the ceramic or metallic material and comprises openings 30 at its ignition side end, so that the air can flow out of the flow passages between the two sleeves 22, 26 via the openings 30 into the interior of the hollow cylinder 28.

As suitable materials for the walls of the cylinder 28 metallic materials, ceramic materials and cardboard, in particular for the outer wall, may be used.

The advantage of the configuration of the carrier 28 as a hollow cylinder lies in that it can be formed in one piece with the integrated inner ceramic or metallic sleeve 26, so that the unit of the sleeve 26 and the carrier 28 only has to be pushed onto the combustion element 17.

Finally, the hollow body is surrounded radially outwardly by a sheath, for example of cigarette paper, which is not shown in FIG. 2.

After igniting the left end of the combustion element 17, according to the illustration in FIG. 2, the smoker draws in the usual manner on the mouth side end of the smokable article 10 provided with the filter 16, whereby air flows in the direction of the arrow 36 through the flow passages 34 of the combustion element 17 and heats up. On the right end in accordance with the illustration in FIG. 2 the air leaves the flow passages 34 and enters a cavity 19 between the right end face of the combustion element 17 and the right end face of the metal sleeve 26 and flows radially outwardly as indicated by the arrows 38.

Thereafter the air flows back to the ignition side end of the combustion element 17, that is through the flow passages between the metal sleeve 26 and the sleeve 22 of ceramic material and then flows via the openings 30 in the metal sleeve 26 into the hollow body 22, in which it flows in the direction of the arrows 40 to the mouth side end of the hollow body 28 and then via the right open end 32 of the hollow body 28 into the intermediate space 14 with the tobacco material.

At the same time the carrier (hollow body 28) for the aerosol precursor is heated both directly by the combustion element 17 by heat conduction and radiation and also by the heated air, so that the aromatic substances are formed and are entrained by the heated air. On flowing through the intermediate space 14 with the tobacco material additional active and flavouring substances are entrained and reach the smoker's mouth via the mouthpiece 16.

Figure 3:
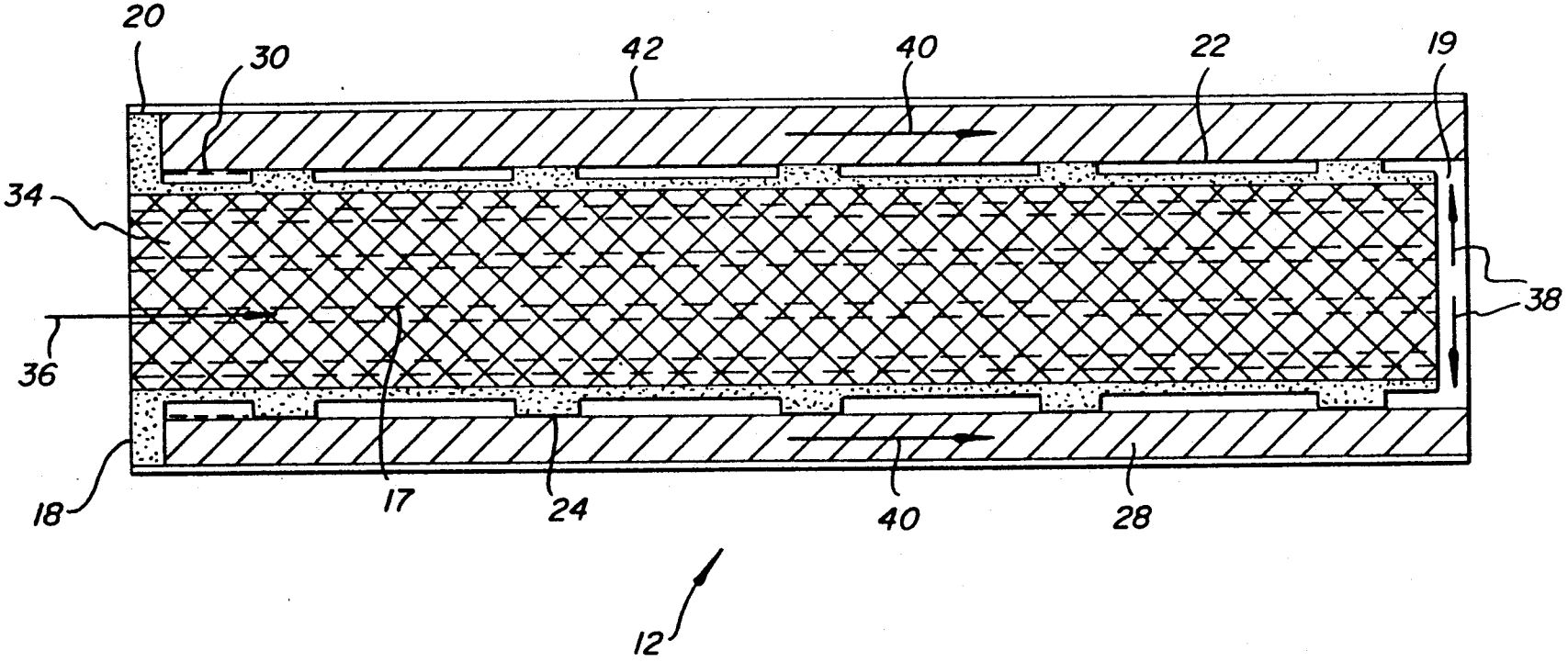
FIG. 3 shows a view corresponding to FIG. 2 of a further embodiment of the aerosol generating zone of the smokable article.

FIG. 3 shows an embodiment of the aerosol generating zone 12 which differs from the embodiment according to FIG. 2 essentially in the configuration of the carrier 28 for the aerosol precursor. For, in this case, the carrier 28 for the aerosol precursor is formed by a multilayer fleece of ceramic fibres which is surrounded by a sheath 42 with low porosity.

As outer sheath 42, for this purpose, but also for the embodiment according to FIG. 1, paper, in particular cigarette paper, cellulose acetate foils or plastic foils may be used.

It can be seen from FIGS. 2 and 3 that the carrier 28 projects at the mouth side end of the aerosol generating zone 12 beyond the end of the combustion element 17 in order to thus form a safety zone and eliminate any direct contact between the hot combustion element 17 and the adjoining tobacco material 14.

Moreover, the embodiment according to FIG. 3 has the same structure and also the same mode of operation as the embodiment according to FIG. 2, so that a further explanation is not necessary.

On configuring the aerosol generating zone the following specifications should be taken into consideration:

The combustion element 17 is to be composed of active carbon, in particular of pyrolized plant material and have a length of 5 to 45 mm, in particular 8 to 20 mm and a diameter of 3 to 5 mm.

The ratio of the flow passages 34 to the volume of he combustion element 17 should be construed so that the flow passage volume takes up 10 to 50% of the entire volume of the combustion element 17.

The gas-impermeable sleeve 22 of the ceramic material should have a thickness of at least 0.5 mm. The radial height of the spacers 24 should lie between 0.3 and 0.7 mm in order to ensure an adequate flowthrough.

The distance between the combustion element 17 and the mouth side metal surface should be 1 to 5 mm.

On the ignition side the distance between the gas-impermeable ceramic layer 20 and the metal sleeve 26 on the spacers 24 should lie in the range from 1 to 5 mm.

Finally, if necessary, at the ignition side, beginning on the outside, a surrounding sheath having a length of 5 to 10 mm and consisting of non-ignitable material may be provided as ignition protection. This could be necessary in particular when the carrier 28 for the aerosol precursor is composed of a porous hollow cylinder of ceramic material or of a fleece of ceramic fibres.

We claim:

1. A smokable article, comprising:

an aerosol generating section which includes a combustion element and a carrier coaxially receiving said combustion element, said carrier having an aerosol precursor and being composed of porous material for passage of gasses therethrough, said combustion element having a plurality of axial passages along the entire length thereof;

a mouthpiece connected for communication with the gasses passing through said carrier, and at least one outer sheath surrounding said carrier and said mouthpiece, said outer sheath being substantially impermeable to flow of the gasses passing through said carrier;

a jacket surrounding said combustion element, said jacket being composed of a gas-impermeable heat-insulating material;

a sleeve concentrically surrounding said jacket in spaced relationship to said jacket, said sleeve being composed of a gas-impermeable material, a flow space existing between said jacket and said sleeve, said flow space being in communication with said axial flow passages; and said sleeve having an ignition side end which is open and a mouth side end, said mouth side end of said sleeve projecting beyond a mouth side end of said combustion element, said mouth side of said sleeve being closed by an interior mouth side end of said carrier such that a flow deflection space is formed to deflect a flow of gasses from said mouth side end of said combustion element to said flow space surrounding said sleeve.

2. A smokable article according to claim 1, wherein said combustion element is substantially cylindrical, and said flow passages in said combustion element have a substantially circular cross section.

3. A smokable article according to claim 1, wherein a circumferential surface of at least one of said combustion element and said jacket is corrugated and thus permits a longitudinally axial air flow between said combustion element and said jacket.

4. A smokable article according to claim 1, wherein the jacket consists of a ceramic material.

5. A smokable article according to claim 1, wherein the sleeve consists of a metallic material.

6. A smokable article according to claim 1, wherein spacers are arranged between the jacket and the sleeve.

7. A smokable article according to claim 6, wherein the spacers are formed integrally with the outer surface of the jacket.

8. A smokable article according to claim 1, wherein said ignition side end of said sleeve includes a plurality of openings which permit air which is transported from said ignition end to flow through to said carrier.

9. A smokable article according to claim 1, wherein said carrier carrying said aerosol precursor is formed by a multilayer fleece of ceramic fibres, and further comprises a sheath of low porosity material surrounding said multilayer fleece.

10. A smokable article according to claim 9, wherein said sheath is composed of paper.

11. A smokable article according to claim 9, wherein said sheath is composed of foil.

12. A smokable article according to claim 1, wherein said carrier for said aerosol precursor is formed by a hollow body composed of a porous ceramic material and further comprises a gas-impermeable circumferential surface which is composed of a material having low porosity.

13. A smokable article according to claim 1, wherein said carrier for said aerosol precursor is formed by a hollow cylinder which is filled with a porous granulate impregnated with aroma substances.

14. A smokable article according to claim 13, wherein the hollow cylinder is made integrally with the sleeve.

15. A smokable article according to claim 12, wherein said hollow cylinder is composed of a metallic material.

16. A smokable article according to claim 13, wherein said hollow cylinder is composed of a ceramic material.

17. A smokable article according to claim 13, wherein said hollow cylinder is composed of cardboard.

18. A smokable article according to claim 1, wherein the carrier consists at least partially of tobacco material.

19. A smokable article according to claim 1, wherein said combustion element is substantially cylindrical, and said flow passages in said combustion element have a partially circular cross-section.

20. A smokable article according to claim 1, wherein said combustion element is substantially cylindrical, and said flow passages in said combustion element have a semicircular cross-section at a radial outer edge of said combustion element.

* * * * *